United States Patent [19]

Civitello

[11] 4,289,936

[45] Sep. 15, 1981

[54] ELECTROSTATIC TRANSDUCERS

[76] Inventor: John P. Civitello, 226 Vreeland Ave., Paterson, N.J. 07504

[21] Appl. No.: 137,576

[22] Filed: Apr. 7, 1980

[51] Int. Cl.[3] ..... H04R 19/00

[52] U.S. Cl. ..... 179/111 R

[58] Field of Search ..... 179/111 R

[56] References Cited

U.S. PATENT DOCUMENTS 3,778,562 12/1973 Wright ..... 179/111 R

FOREIGN PATENT DOCUMENTS 601096 7/1934 Fed. Rep. of Germany ... 179/111 R
1234767 6/1971 United Kingdom ..... 179/111 R
1239658 7/1971 United Kingdom ..... 179/111 R

*Primary Examiner*—George G. Stellar

[57] ABSTRACT

A simplified electrostatic loudspeaker consisting of two outer diaphragms laminated to a one-piece dielectric spacer/grid electrode which serves to separate the diaphragms, hold the bias voltage as well as provide the essential skeletal structure whereby a geodesically-curved surface transducer is configured to provide broadened sound radiation dispersion in the vertical and horizontal dimensions of the listening environment. Additionally, said diaphragms carry external conductive layers whereby a transformer coupled signal voltage is applied through a unique laminated conductive connection tab which results in a minimum stray resistance and capacitance signal interconnection system.

1 Claim, 6 Drawing Figures

ELECTROSTATIC TRANSDUCERS

BACKGROUND OF THE INVENTION

It has long been a goal of electrostatic loudspeaker designs to deliver widely dispersed sound, particularly at high frequencies, without the narrow and directional beaming that often occurs. Examples of electrostatic speaker designs in the prior art to which a broadened dispersion was sought can be found in: LINDENBERG, U.S. Pat. No. 2,615,994; ROD, U.S. Pat. No. 3,345,469; JANSZEN, U.S. Pat. No. 2,896,0^5; STANTON, U.S. Pat. No. 2,934,612; STEEDLE, U.S. Pat. No. 1,809,754 and KUEHN, U.S. Pat. No. 2,916,562.

A common mechanism which many of the above inventors used was a faceted, angled or curved placement of the speaker units to widen the horizontal angles of sound radiation. This proved to be a useful device but it did not allow for a widening of dispersion or directivity in the vertical dimension of the listening area.

The orthodox use of quadratic speaker profiles and their accompanying bulky, mechanically fastened frame structures in the prior art limited the disposition of the grouped units to cylindrical curvatures along the horizontal dimensions. This approach does not take into account the spherical nature of sound wavefronts and limits the speaker produced wavefronts to fragmental and often planar sections of the original three dimensional sound envelope. Further, the spherical nature of sound radiation suggests the need in reproduction processes of recreating the original source wavefronts as closely as possible for faithful fidelity.

The present invention described herein provides improvements to basic speaker elements, construction, assembly and performance characteristics as they relate to the above described design goals. Additionally, the present invention because of its advantageous design parameters which depart from the commonly used methods has the ability to be applied to many figurations including combined geometries which can yield thereby applications suited for differing spatial environments.

SUMMARY OF THE INVENTION

It is an essential object of this invention to provide a simplified, lightweight, laminated electrostatic loudspeaker consisting of three basic elements.

It is a further object of this invention to configure thereby a geodesically sectioned and curved transducer which provides a broadened and uniformly dispersed sound radiation pattern in the vertical as well as the horizontal dimensions of the listening area.

It is still a further object of this invention to readily apply the speaker design lamination to other figurations including combined geometries for differing rooms.

It is a further object of this invention to couple each geodesically sectioned electrostatic speaker unit by joining, bonding or adhering techniques which provide resonance dampening control by flexible jointing while maintaining overall structural integrity of the transducer surface.

It is a further object of this invention to provide a simplified means of diaphragm signal connection and diaphragm interconnection by means of a laminated conductive tab which obviates the problems associated with bulky connectors and wire which add stray resistance and capacitance to the speaker circuit.

These and other objects of the invention will be seen from the detailed description and the accompanying illustrations which follow.

DETAILED DESCRIPTION

Figure 1:
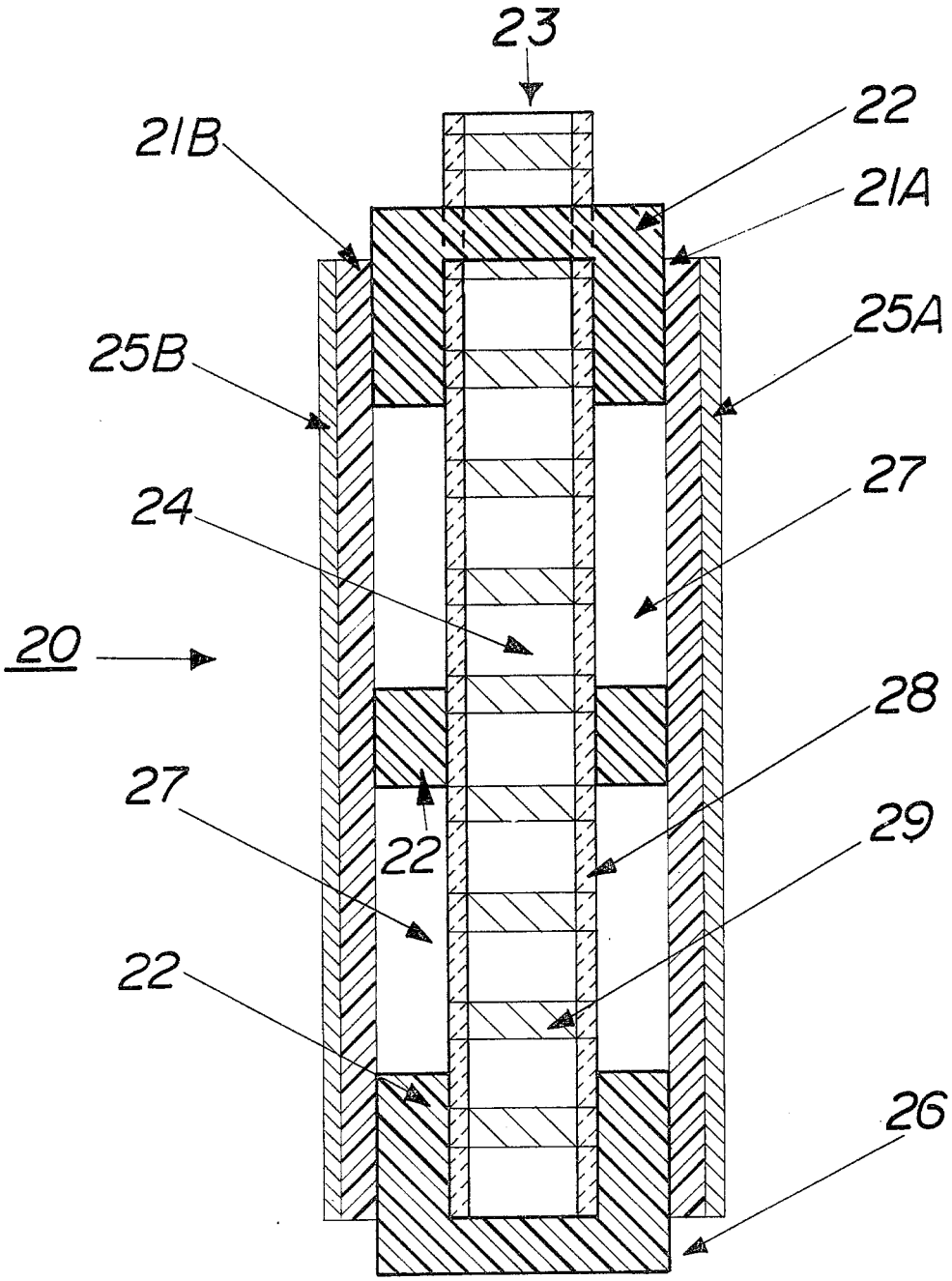
FIG. 1 is a cross-sectional view of the present invention described herein.
Figure 2:
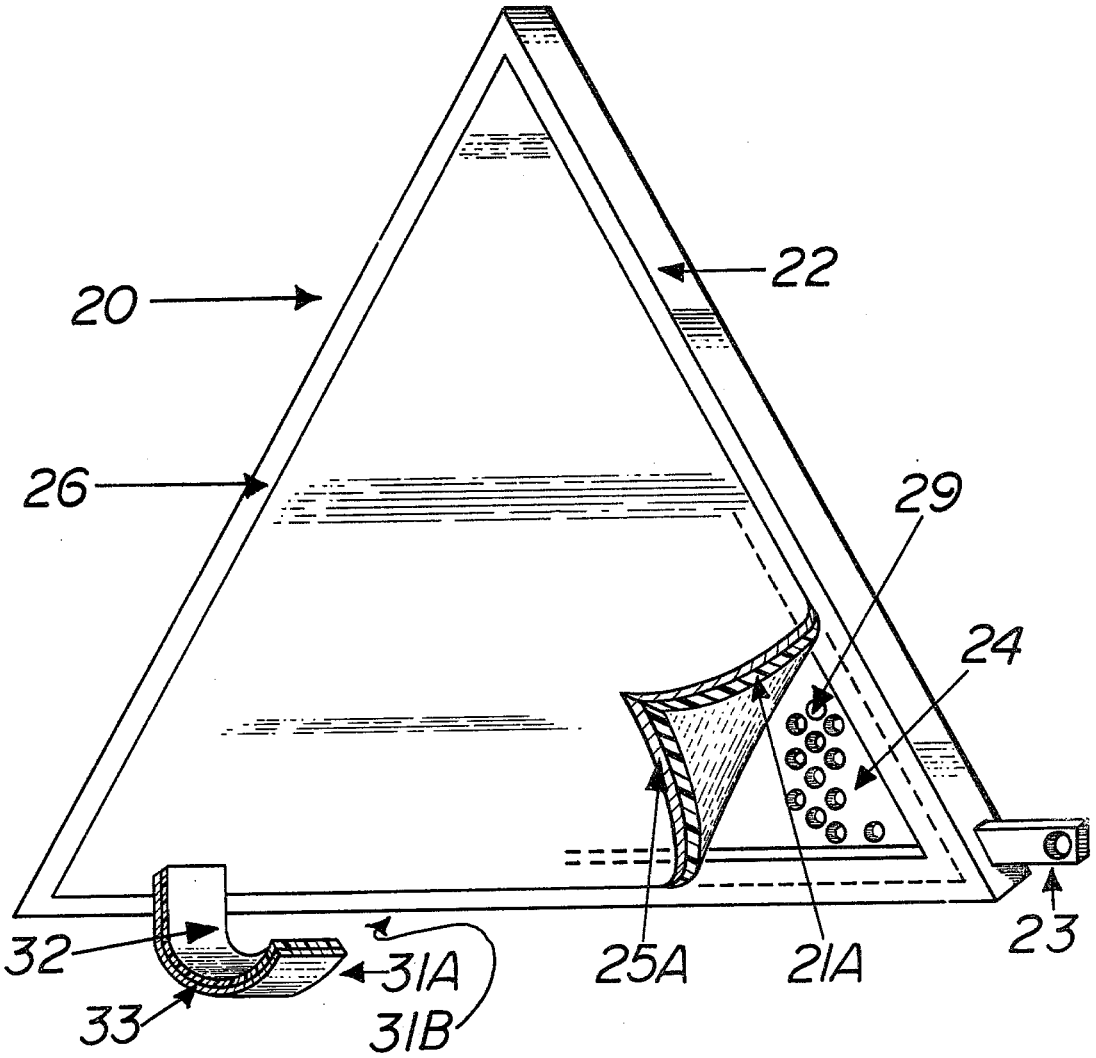
FIG. 2 is a front view of the invention described herein.

Referring to the drawings of FIGS. 1 and 2 it can be seen that the electrostatic speaker 20, described herein consists of two outer diaphragms 21A and 21B each placed in a parallel condition by means of spacers 22, which are disposed on each side of a central and fixed perforated, conductive grid 24. Each diaphragm 21A and 21B carries an externally oriented conductive layer 25A and 25B. Diaphragm thickness may vary but is typically between 0.00010 inches and 0.00050 inches and is composed of a plastic dielectric film, film graft or film/foil laminate.

Dielectric spacers 22, are of a selected thickness and are composed of a low dissipation factor thermoplastic or adjusted dielectric constant multi-plastic grafted material. The conductive grid 24, is perforated with through openings 29, and may also carry a dielectric layer 28 integral to the surface of the conductive grid 24. Dielectric spacers 22, are laminated with one or a combination of heat, pressure and adhesive from sheet material or by direct molding processes onto the central and fixed conductive grid 24, to form an integral, one-piece spacer/grid 22,24 which acts as the transducer skeletal member providing important structural rigidity for the overall geodesically sectioned transducer of FIGS. 4A and 4B.

A conductive grid electrode 23, passes between the dielectric spacers 22, at one point to provide an electrical connection for the d.c. bias voltage which is applied to the conductive grid 24.

The diaphragms 21A and 21B are tensioned by stretching over a flat rigid surface to which the one-piece spacer/grid 22,24 is laminated by one or a combination of heat, pressure or adhesive. The diaphragm lamination process creates air spaces 27 which are acoustically coupled to the diaphragms by through openings 29, of the grid, 24. The stretching and lamination of the membranes is repeated for both sides of the spacer/grid 22, 24 or is accomplished simultaneously by means of a clamping jig to hold the grid assembly firmly.

During application of the laminated diaphragms, a border 26, is left on the spacer 22, which allows for points of joining around the perimeter of the speaker 20, for the final assembly stage.

Each completely laminated speaker unit 20, is laid into place on a geodesically-curved jig or mold and bonded or joined at points 26, by one or a combination of techniques including flexible and non-flexible methods such as interlocking joints, fasteners, clips, adhesives, ultrasonic and thermal welding, etc.

Flexible joining holds significant benefits for dampening of vibrations. This is important for wafer-thin acoustic vibrating devices and has shown to effectively decouple each geodesic speaker unit from adjacent units thereby reducing by dampening spurious structural resonances that can add colorations to the reproduced sound.

Connection points for the signal voltage are applied to the diaphragms conductive layers 25A and 25B by a laminated, dielectric/conductive tab 31A and 31B of FIG. 2. The laminated tab is composed of a plastic dielectric film tape 32, and a conductive layer 33, which is applied by one or a combination of heat pressure or adhesive. This method of signal connection serves as a simple and convenient as well as inexpensive diaphragm interwiring system with minimum stray resistance and capacitance which can add to the capacitive speaker electrical circuit detracting from efficiency and high frequency response. Also, there is no need for bulky connectors and wire which adds to manufacturing costs.

Figure 3:
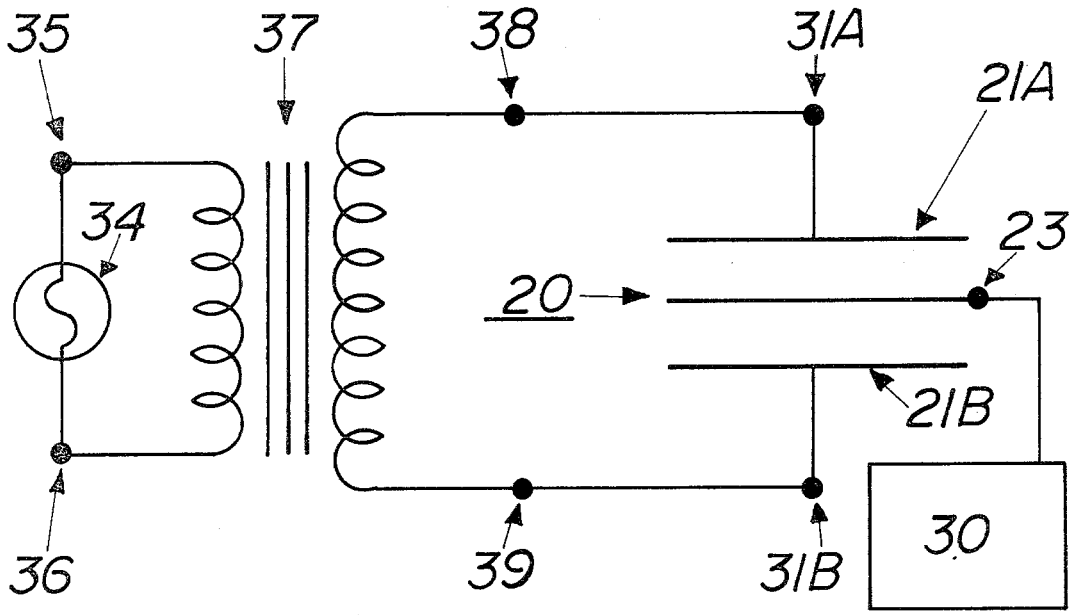
FIG. 3 is the circuit schematic.

The speaker unit 20, is then connected to the electrical circuit as shown in the illustration of FIG. 3. A low output impedance, solid state amplifier 34, is adequate to supply an AC signal voltage to the primary windings 35, 36 of the transformer 37. The transformer turns ratio is chosen for maximum voltage at an optimum acoustic efficiency. The secondary windings 38, 39 provide signal voltage step-up which is applied through the laminated connection tabs 31A and 31B to the diaphragm conductive layers 25A and 25B.

The centrally fixed, perforated and conductive grid 24, is biased with a high voltage d.c. potential supply 30, at point 23, the grid electrode. The bias voltage should be greater than the maximum peak to peak signal voltages generated at the secondary windings 38,39 of the coupling transformer 37. This produces excellent acoustic efficiency approaching the somewhat more efficient dynamic speaker at about 90 decibels for one watt input at 1000 Hertz.

Figure 4A:
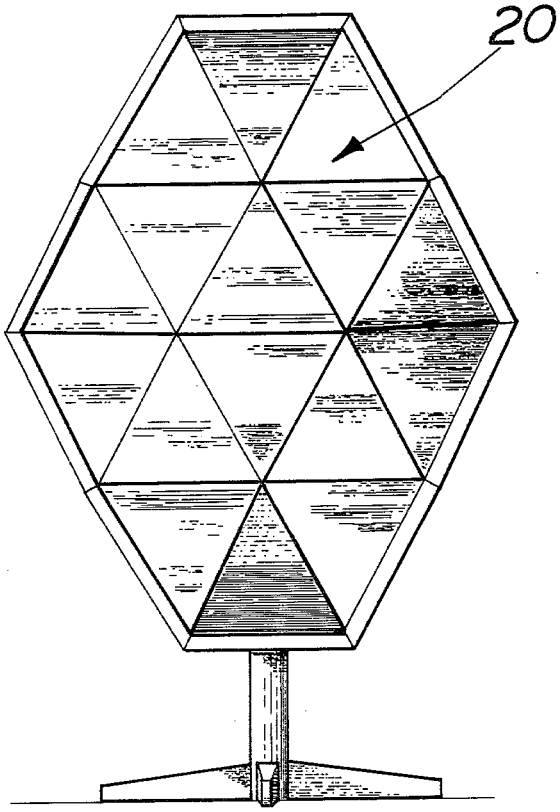
FIG. 4A is a front view of a typical embodiment.
Figure 4B:
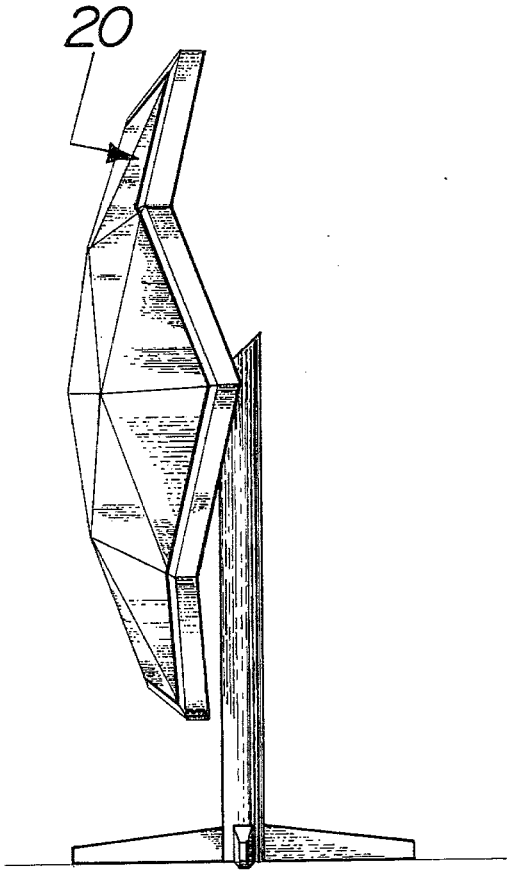
FIG. 4B is a side view of a typical embodiment.

FIGS. 4A and 4B illustrate two views of a typical embodiment of the invention. FIG. 4A shows a front view of a sixteen unit 20, geodesically-curved surface transducer which is based on a triangular geometry. It should be noted that combined geometrical figures can also yield geodesically-curved transducer structures. An example of combined geometries is the cuboctahedron which possesses six square and eight triangular faces. A section of the cuboctahedron curvature could provide added direct, early arrival acoustic information for difficult acoustic environments by virtue of a large surfaced square unit combined with omni-directional smaller triangular units. The advantages of the present invention's laminated design, constructional and assembly features easily make it suitable to adapt to differing profiles and spatial environments.

Figure 5:
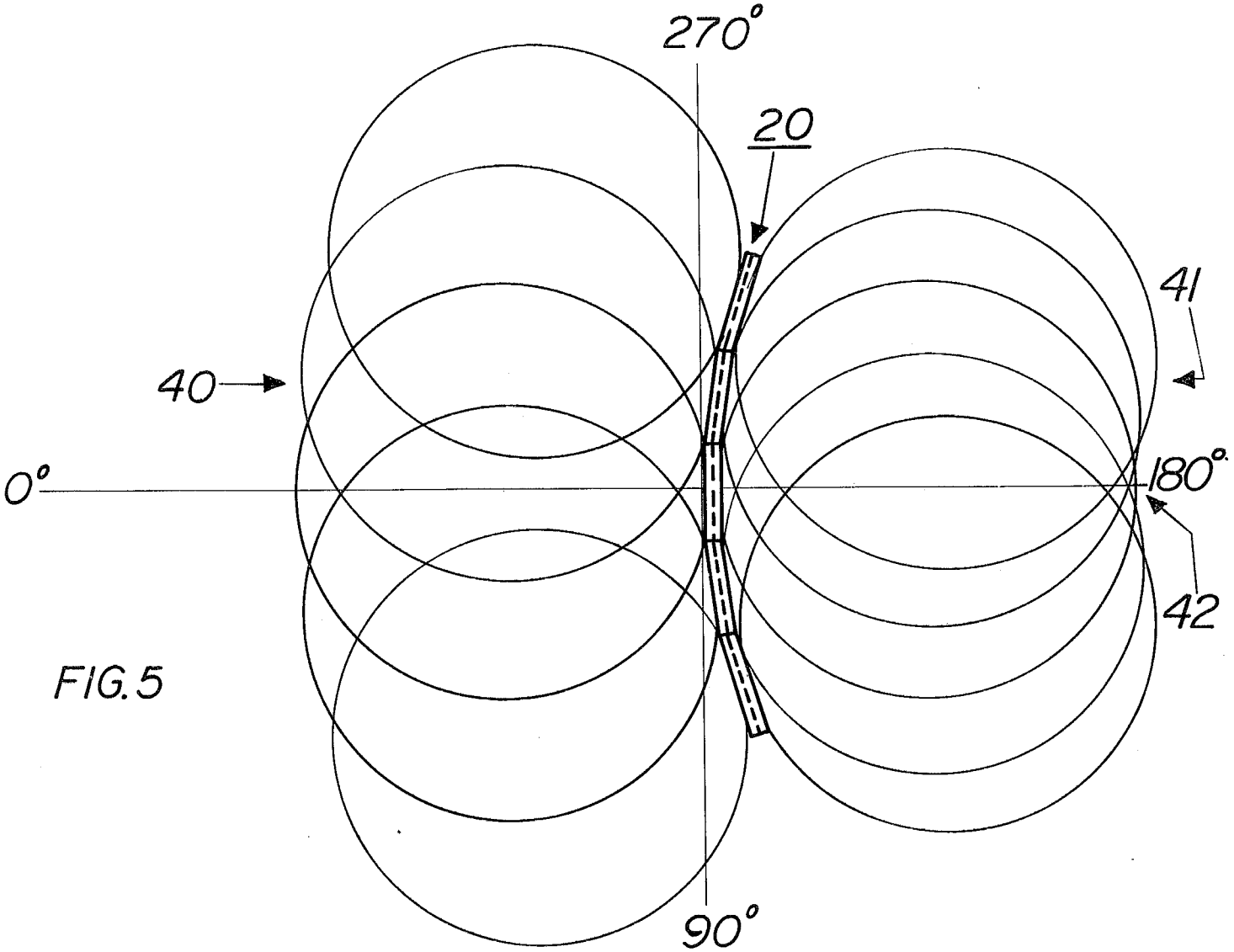
FIG. 5 is a cross-sectional view of the curved surface transducer's vertical dipole radiation pattern.

Referring to FIG. 5, the invention described herein demonstrates considerably wider vertical directivity characteristics as can be seen by a cross-sectional view of the vertical dipole radiation pattern of the geodesically-curved transducers 20. The frontal dipole radiation lobes 40 illustrate the resultant widening because of the close alignment with minimum angular offset of the grouped speaker array. While the curving or folding back of the speaker units 20, describes a convexity of front propagating surface, the rear propagating surface folds in slightly to become concave. The doublet radiation pattern of FIG. 5 shows a cross section of the vertical axis of the curved transducer array, 20. The frontal lobes 40, depict the widening of the sound directivity pattern into a broadly angled spherically shaped wavefront. The rear dipole lobes 41, overlap one another and become focused at point 42, which is the inverse of the frontal pattern, 40. This somewhat attenuated back radiation pattern can be of advantage in the listening area as it enhances sound field ambience for a more balanced sound field over a large listening area in combination with the uniformly broadened dispersion of the frontal sound pattern.

I claim:

1. An electrostatic transducer the combination comprising:

a. two outer dielectric diaphragms carrying conductive layers which are laminated in a parallel condition to b. a one-piece dielectric spacer/centrally fixed and perforated conductive grid serving as an essential skeletal structure wherein c. geodesically-curved transducer arrays are configured and result in broadened sound radiation patterns in the vertical and horizontal dimensions of the listening area d. non-resonant dampening means for joining adjacent transducers thereby decoupling adjoining speaker units without loss of structural integrity e. a laminated dielectric/conductive tab which serves as a diaphragm signal connection electrode as well as a diaphragm interconnecting system allowing adjacently curved geodesic diaphragms to be "interwired" without bulky connectors or strands of wire f. a transformer to which its primary winding is supplied a signal voltage and to which its secondary winding is connected across said electrostatic transducer's diaphragm conductive layers; and, there being an additional connection of a high voltage d.c. biasing potential to said electrostatic transducer's fixed conductive grid via its electrode connection point.

* * * * *